United States Patent [19]

Crissy

[11] 3,930,446

[45] Jan. 6, 1976

[54] DUPLICATOR WITH WEB MASTER

[75] Inventor: Robert J. Crissy, West Caldwell, N.J.

[73] Assignee: Edmund W. Nulton, Elizabeth, N.J. ; a part interest

[22] Filed: Aug. 23, 1974

[21] Appl. No.: 500,046

[52] U.S. Cl. ..... 101/132; 101/228; 101/426

[51] Int. Cl.[2] ..... B41L 9/00

[58] Field of Search ..... 101/132, 132.5, 52, 53, 101/54, 92, 247, 228

[56] References Cited

UNITED STATES PATENTS

| | | | |
|---|---|---|---|
| 492,893 | 3/1893 | Murray | 101/178 |
| 1,282,131 | 10/1918 | Smith | 101/228 |
| 1,349,807 | 8/1920 | Brayer | 101/132.5 X |
| 2,026,434 | 12/1935 | Quick et al. | 101/247 |
| 2,057,360 | 10/1936 | Barber | 101/178 |
| 2,172,414 | 9/1939 | Sherman | 101/228 |
| 2,340,819 | 2/1944 | Mills | 101/132.5 |
| 3,241,484 | 3/1966 | Crissy | 101/132.5 |
| 3,373,684 | 3/1968 | Fisher | 101/228 |
| 3,548,747 | 12/1970 | D'Amato | 101/228 X |

*Primary Examiner*—J. Reed Fisher
*Attorney, Agent, or Firm*—Brumbaugh, Graves, Donohue & Raymond

[57] ABSTRACT

A duplicating method and apparatus in which information is transferred onto a copy web from a master web and a repeat printing roll and in which a common impression cylinder carries the copy web past a pressure roll which cooperates with the impression cylinder for bringing the master web in printing contact with the copy web to print equally spaced indicia from the master web on the copy web and the repeat printing roll cooperates with the impression cylinder for printing repeat indicia on the copy web, and including a sheeter for separating the copy web at spaced lengths, each length including an impression from the master web and an impression from the repeat printing roll.

9 Claims, 6 Drawing Figures

FIG. 5
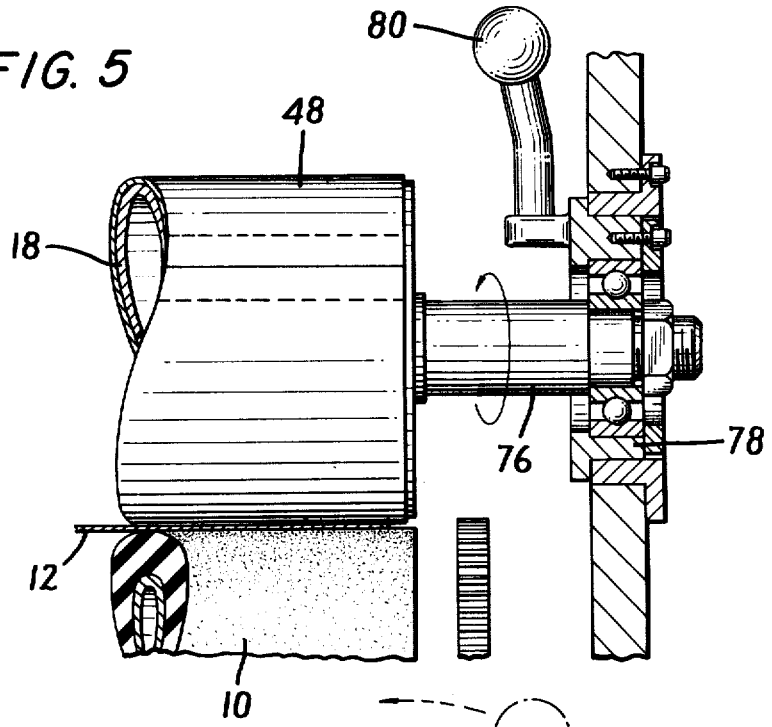
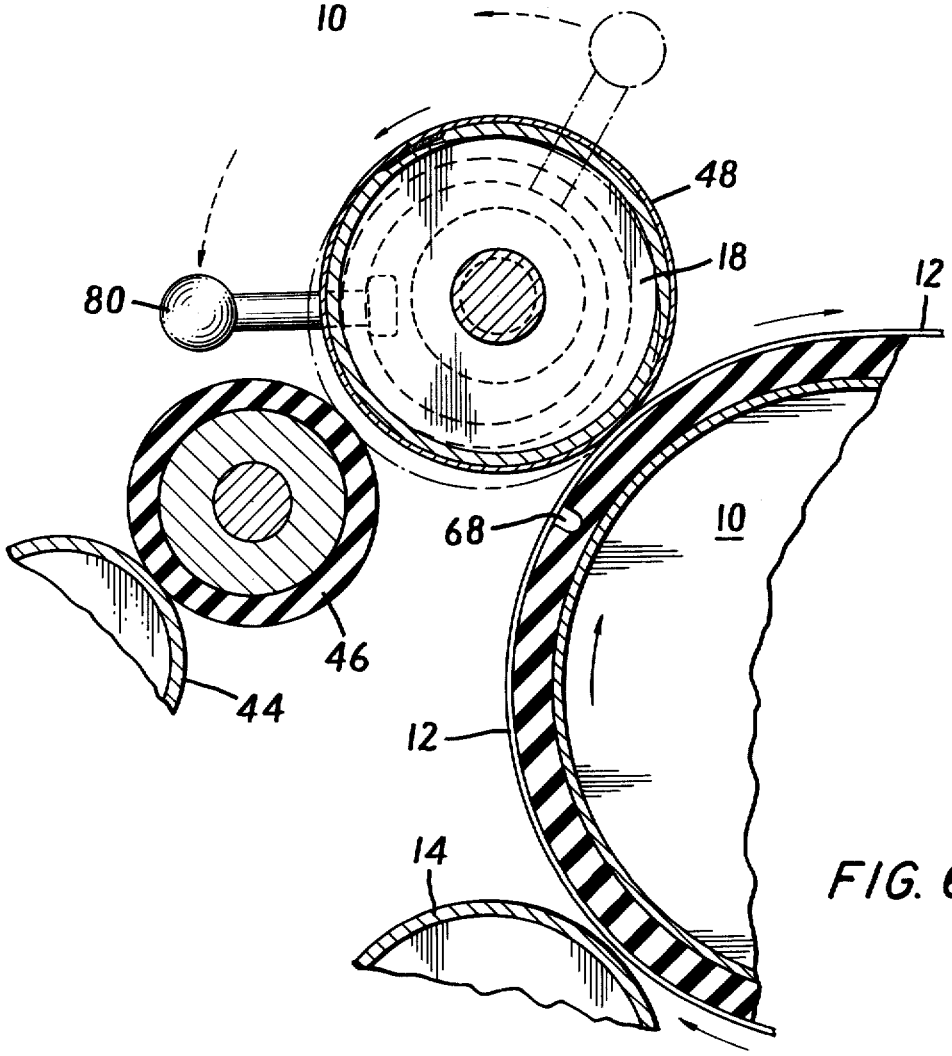
FIG. 6

DUPLICATOR WITH WEB MASTER

FIELD OF THE INVENTION

The present invention relates to improvements in duplicating apparatus of the type described in U.S. Pat. No. 3,241,484 to Robert J. Crissy and, more particularly, to a continuous duplicator for printing repeat and variable information onto a plurality of duplicated sheets or forms.

SUMMARY OF THE INVENTION

The object of the present invention is to provide a continuous duplicating method and apparatus capable of producing multi-copies of variable information from a master web, such as a web printout of a computer or any other impact printout device, onto a repeat printed form in which the entire printing-duplication operation takes place while a copy web, which is separated into the individual forms, is in contact with a common impression cylinder.

The method and apparatus of the present invention are carried out by feeding a copy web to an impression cylinder, bringing the master web having variable information thereon into pressure contact with the impression cylinder to print the variable information onto the copy web as the webs are fed between a pressure roll and the impression cylinder, printing the form by a repeat printing roll while the copy web is still in contact with the impression and then separating the copy web into individual forms.

BRIEF DESCRIPTION OF THE DRAWINGS

For a further understanding of the present invention, reference may be had to the accompanying drawings, in which:

FIG. 5 is a sectional view taken along the line 5—5 looking in the direction of the arrows; and FIG. 6 is a fragmentary enlarged sectional view of FIG. 1 showing the repeat printing roll in a shifted position.

DESCRIPTION OF THE INVENTION

Figure 1:
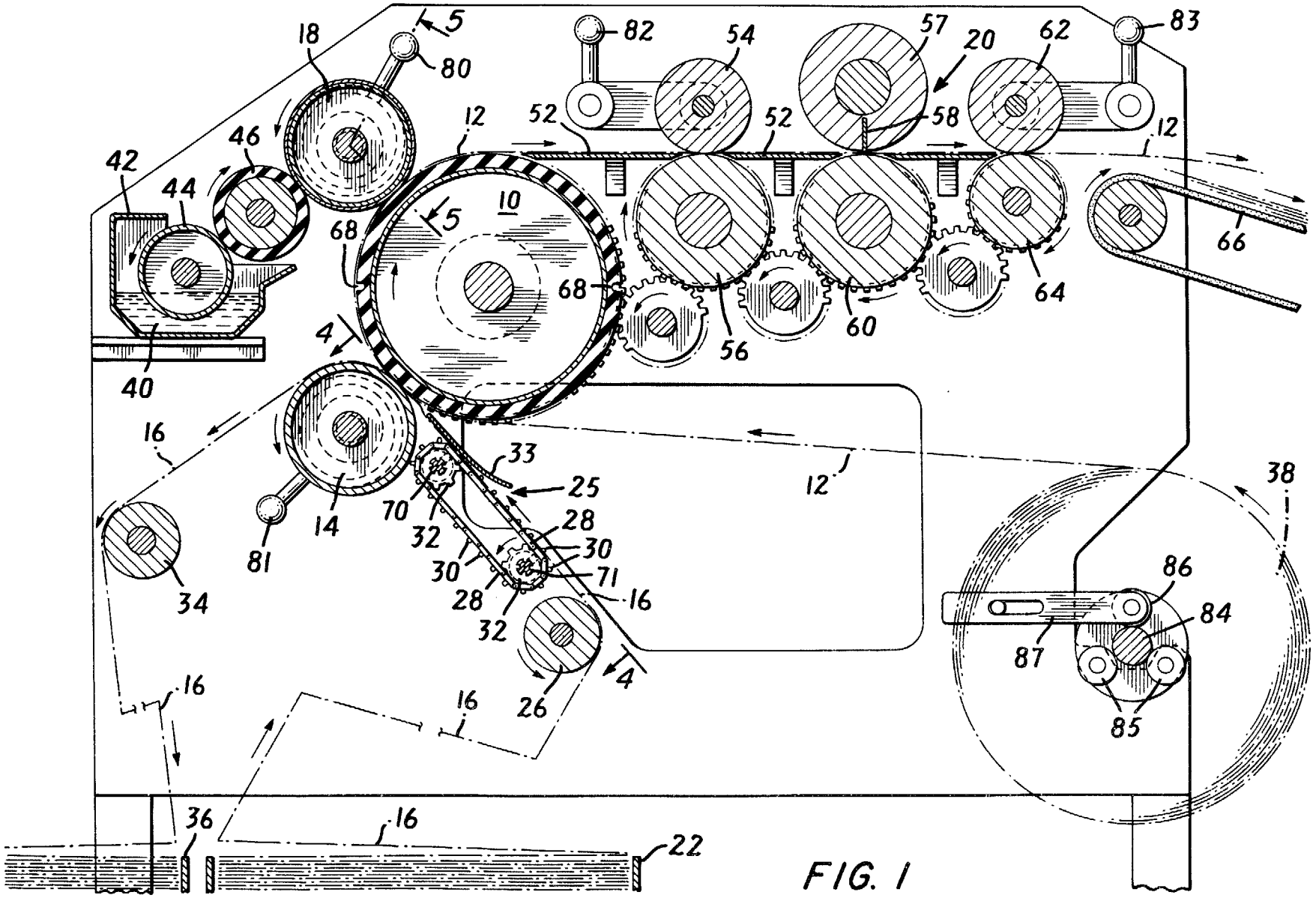
FIG. 1 is a sectional side elevation of the apparatus embodying the present invention.

The continuous duplicator-printer of the present invention, as shown in the drawings, includes a common impression cylinder 10 for carrying a copy web 12 through at least two printing impressions, a pressure roll 14 for bringing a master web 16 in printing contact with the copy web 12 to print or duplicate variable indicia from the master web 16 onto the copy web 12, a repeat printing roll 18 for printing complementary repeat indicia on the copy web 12 seriatim on spaced lengths in register with the duplicated variable indicia printed by the master web 16, and a sheeter 20 for separating the copy web 12 at spaced lengths such that each separated length of the copy web 12 has printed thereon the variable indicia from the master web 16 and the repeat indicia from the repeat printing roll 18.

The master web 16 may be a computer printout having a series of names and addresses printed thereon in mirror image in a conventional ink capable of dry printing the variable information onto the copy web 12. The master web 16 is stored in zig-zag fashion in a magazine 22, and the feed holes 24 (see FIG. 4) spaced along both edges of the master web permit it to be fed in proper register with the system by a pin feed unit 25. The master web 16 is fed from the magazine and around a tension roller 26 by the pin feed unit which includes a pair of endless chains 28 and 28' (see FIG. 4) having pins 30 and 30', respectively, which mate with the pin holes 24 in the master copy 16. The endless chains 28 and 28' are driven by pairs of sprocket wheels 32 and 32', respectively.

The misalignment of the feed pins 30 and 30' with pin holes 24 results in the elongation and/or mutilization of the pin holes, thereby rendering the master web useless for subsequent runs through the apparatus. To avoid such misalignment, the pin feed advances the master web slightly faster than the feed of the master web and copy web by the impression cylinder and pressure roll, thereby tending to produce a bulge in the master web 16 immediately prior to its being fed between the common impression cylinder 10 and the pressure roll 14 (see FIG. 2). To eliminate this bulge in the master web, pressure reliefs 68 (to be described hereinbelow) are employed to relieve the pressure on the master web and thereby insure that the pin feed does maintain the proper registration of the master web.

Registry and alignment of the master web and the copy web are preserved by making each length of the master web between folds slightly longer than each cut length of the copy web by the amount of overfeed of the master web.

The master web passes under a guide 33 as it leaves the pin feed unit, and the variable information contained on the master web is transferred onto the copy web as they come into pressure contact with one another while passing between the pressure roll 14 and the larger impression cylinder 10. After the duplicating operation, the master web 16 is fed over a tension roller 34 and stacked in zig-zag fashion in a magazine 36.

The copy web 12 is supplied from a roll 38 and is carried in engagement with the impression cylinder into pressure contact with the master web and then into printing contact with the printing roll 18 which prints the repeat information on the copy web 12 in proper register with the information printed thereon by the master web.

The printing roll 18 carries a printing plate 48 which is supplied with ink 40 from a reservoir 42 by an inking roller 44 partially submerged in the ink and an ink transfer roller 46 which is interposed between the inking roller 44 and the printing roller.

After receiving the impression from the repeat printing roll, the copy web 12 is fed in a taut condition across a substantially horizontal platform 52 to the sheeter 20 by means of a pair of pull rolls 54 and 56. The sheeter includes a rotatable roll 57 having a cutting blade 58 extending radially outward therefrom which cooperates with roller 60 to cut the copy web 12 at spaced lengths into separate forms, each form having printed thereon the information from one of the master webs and the information from the repeat printing roll. The individual forms are then transferred by means of ejector rolls 62 and 64 to a conveyor 66 which transfers the forms to a suitable stacking or shingling device.

Figure 2:
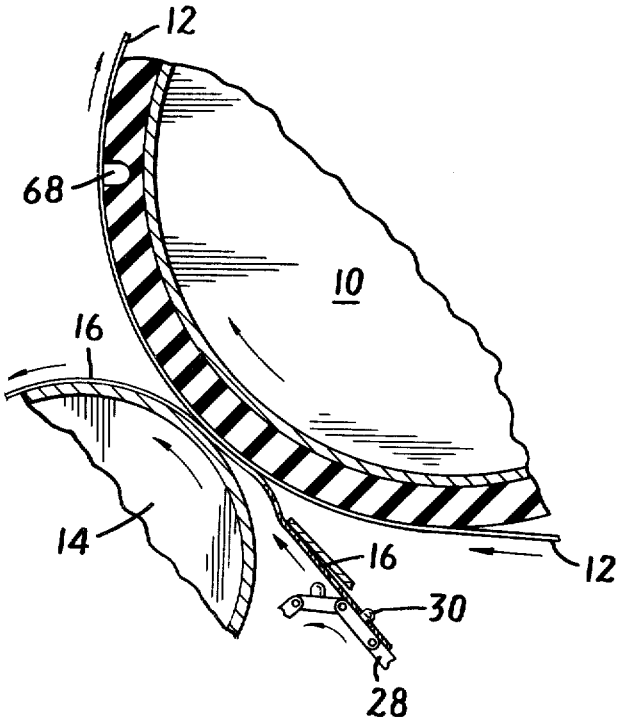
FIG. 2 is a fragmentary sectional view of part of FIG. 1 showing the feed of the master web and the copy web between the impression cylinder and the pressure roll.
Figure 3:
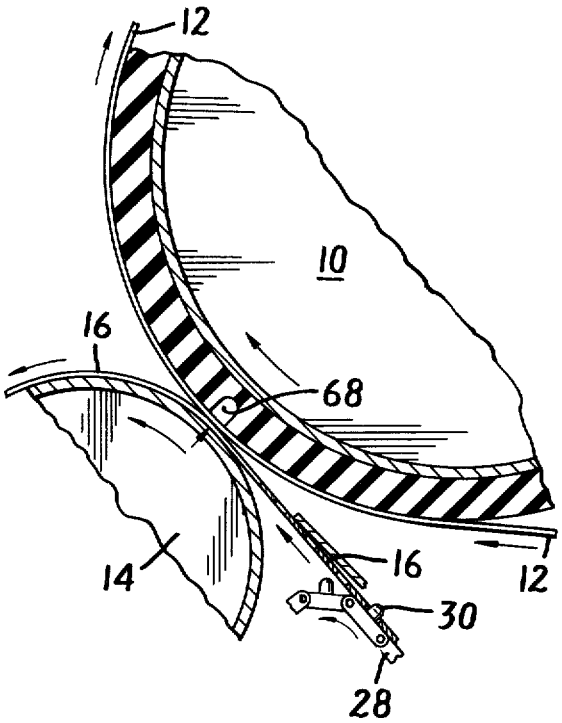
FIG. 3 is a view similar to FIG. 2 showing how proper registration is maintained by a pressure relief feature of the present invention.

As mentioned hereinabove, the necessary pressure (approximately 2000 lbs. per square inch) to effect the proper dry transfer of data from the master web 16 to the copy web 12, as well as the increased feeding rate of the master web, causes the impression cylinder 10 and pressure roll 14 to have a far greater influence over the feed of the master web than the pin feed 25, as illustrated in FIG. 2, and this pressure would normally prevent the pin feed from maintaining the proper register of the master web with the other operating units of the duplicator. To prevent this, one or more pressure reliefs 68 are formed longitudinally in the outer resilient surface of the impression cylinder 10, as shown in FIG. 3, or in the pressure roller 14 to relieve the pressure on the master web and thereby insure that the pin feed does maintain the proper registration of the master web.

Figure 4:
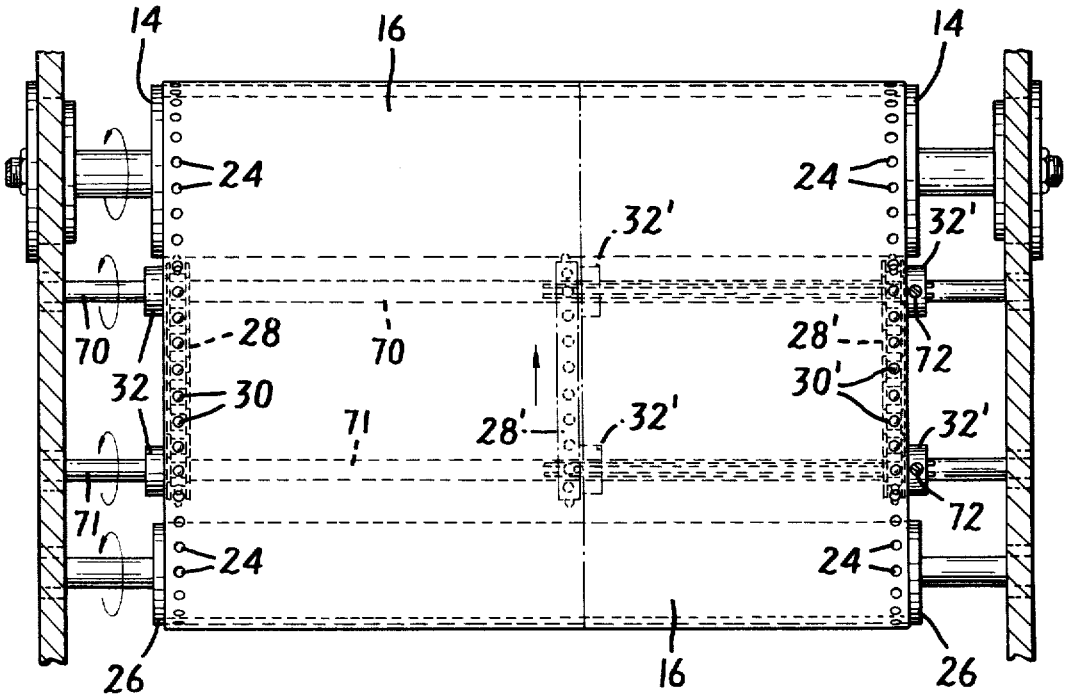
FIG. 4 is a sectional view taken along the line 4—4 of FIG. 1 looking in the direction of the arrows.

To permit the duplicator to accommodate different widths of master web, the sprockets 32' for the pin carrying chain 28' are mounted for adjustment toward or away from the sprockets 32 for the pin carrying chain 28. As shown in FIG. 4, the sprocket wheels 32, which transport pin carrying chain 28, are fixed on the rotatable shafts 70 and 71. However, the sprocket wheels 32', which transport the pin carrying chain 28' on the other side of the carriage, are adjustable along the length of the shafts 70 and 71, as indicated by phantom line position shown in FIG. 4. Lock nuts 72 lock the sprocket wheels 32' in their adjusted positions.

The supporting shaft 76 for the repeat printing roll 18 is mounted at opposite ends in eccentrics 78 operated by control handles 80 which permit the roll 18 to be moved out of engagement with the ink transfer roll 46 to the position shown in FIG. 6 for cleaning the plate 48 on the copy paper fed by the impression cylinder. The eccentrics 78 can also be mounted within other eccentrics to permit the roll 18 to be moved out of engagement with both the ink transfer roll and the impression cylinder. A similar eccentric mounting controlled by handles 81 is provided to separate the pressure roll 14 from the impression cylinder.

The impression cylinder is driven by a ratio control drive and all of the driven shafts are gear driven from the impression cylinder. The upper pull roll 54 and ejector roll 62 are idler rolls which can be lifted from the respective lower rolls 56 and 64 by the operation of control levers 82 and 83, respectively.

The supporting shaft 84 for the copy web roll rests at each end on a pair of lower bearings 85 and each end is retained in place by an upper adjustable bearing 86. The bearing 86 is carried by an adjustable support 87 which permits the upper bearing to be moved out of position for changing the copy web roll.

To insure that the forms are printed and cut in proper registry, the circumferences of the repeat printing roll 18 and the path of travel of the cutting blade 58 of the sheeter should be equal. Of course, if more than one printing plate is carried by the roll 18 or more than one cutting blade is carried by the roller 57, the respective circumferences thereof could be multiplied by the number of plates or blades carried. Moreover, the circumferential spacing between the reliefs 68 formed in the impression cylinder preferably is equal to the arc distance between the points of tangency of the repeat printing roll 18 and the pressure roll 14 with the impression cylinder 10 to insure that the relief is presented between and not during printing operations.

This, in turn, suggests that the circumference of the impression cylinder should be a multiple of that circumferential spacing between reliefs, preferably double with two diametrically opposite reliefs formed in the impression cylinder.

The invention has been shown in a single, preferred form by way of example only, and many modifications and variations can be made therein within the spirit of the invention. The invention, therefore, should not be limited to any specified form or embodiment, but should be viewed as covering the subject matter of the claims and equivalents thereof.

I claim:

1. An apparatus for producing individual sheets containing variable information from a master web and repeat information comprising a common impression cylinder for carrying a copy web through at least two printing impressions, a printing cylinder for printing the repeat information on the copy web while the latter is carried on the common impression cylinder, means for separating the copy web at spaced lengths into individual sheets containing printed information from the master web and repeat printed information, positive feed means for feeding the master web toward the copy web while the latter is carried on said common impression cylinder and for feeding the master web at a speed slightly faster than the copy web on said common impression cylinder, a pressure roll for pressing the master web against the copy web while the latter is in contact with the common impression cylinder to transfer information from the master web to the copy web without relative movement between the webs, thereby developing slack in the master web between the pressure roll and the positive feed means, and means automatically relieving the pressure between the common impression cylinder and the pressure roll after each impression to remove the slack developed in the master web.

2. An apparatus as set forth in claim 1 in which the master web is a plurality of individual cards connected by fold lines and having feed holes provided therein and in which the positive feed means includes a pin carrying chain, the pins engaging the holes to provide a positive feed for the master web, and including means for driving the pin carrying chain to achieve proper synchronism between the impression received by the copy web from the master web, the impression received by the copy web from the printing cylinder and the separation of the copy web at spaced intervals.

3. An apparatus as set forth in claim 2 in which the master web has feed holes provided along the edges thereof and including a pair of pin carrying chains and means for adjusting the spacing between the pin carrying chains to accommodate different widths of master webs.

4. An apparatus as set forth in claim 1 in which the means automatically relieving the pressure between the common impression cylinder and the pressure roll is a longitudinally extending recess in the outer surface of the impression cylinder to relieve the pressure between the impression cylinder and the pressure roll intermediate the transfer of impressions from the master web to the copy web.

5. An apparatus as set forth in claim 1, including a pair of rollers for supporting the copy web and maintaining it in a taut condition after the copy web has left the common impression cylinder and before its advance to the separating means.

6. A method of producing individual sheets containing variable information from a master web and repeat information from a rotating printing cylinder comprising the steps of feeding a copy web onto a common impression cylinder which carries the copy web through at least two printing impressions, printing the repeat information on the copy web while the latter is carried on the common impression cylinder, separating the copy web at spaced lengths into individual sheets containing printed information from the master web and repeat printed information from the printing cylinder, positively feeding the master web toward the copy web while the latter is carried on said common impression cylinder and at a speed slightly faster than the copy web on said common impression cylinder, bringing the master web in pressure contact with the copy web while the latter is in contact with the common impression cylinder to transfer information from the master web to the copy web without relative movement between the webs, thereby developing slack in the master web between the pressure applying and positive feeding steps, and automatically relieving the pressure between the common impression cylinder and the pressure roll after each printing impression to remove the slack developed in the master web.

7. A method as set forth in claim 6, including the step of supporting the copy web and maintaining it in taut condition after it has left the common impression cylinder and before it is separated.

8. A method as set forth in claim 6 in which the master is positively fed by means of moving pins which engage holes in the master web, and driving the pin carrying chain to achieve proper synchronism between the impression received by the copy web from the master web, the impression received by the copy web from the printing cylinder and the separation of the copy web at spaced intervals.

9. A method as set forth in claim 6 in which the pressure is automatically relieved by a longitudinal recess formed in the impression cylinder.

* * * * *